US012759687B2

(12) United States Patent
Johnson et al.

(10) Patent No.: US 12,759,687 B2
(45) Date of Patent: Oct. 13, 2026

(54) HULL WITH DEFLECTOR AND WATERCRAFT HAVING SAME

(71) Applicant: BRP MARINE US INC., Clinton, MI (US)

(72) Inventors: Justin Johnson, Silver Lake, WI (US); Corey Rothering, Mount Pleasant, WI (US)

(73) Assignee: BRP MARINE US INC., Clinton, MI (US)

( * ) Notice: Subject to any disclaimer, the term of this patent is extended or adjusted under 35 U.S.C. 154(b) by 476 days.

(21) Appl. No.: 18/365,306

(22) Filed: Aug. 4, 2023

(65) Prior Publication Data

US 2025/0019038 A1 Jan. 16, 2025

Related U.S. Application Data

(60) Provisional application No. 63/513,687, filed on Jul. 14, 2023.

(51) Int. Cl.
*B63H 20/34* (2006.01)
*B63B 1/32* (2006.01)

(52) U.S. Cl.
CPC ..... *B63H 20/34* (2013.01); *B63B 1/32* (2013.01)

(58) Field of Classification Search
CPC ..... B63B 1/32; B63B 2001/005; B63H 20/34
See application file for complete search history.

(56) References Cited

U.S. PATENT DOCUMENTS 4,781,634 A * 11/1988 Harris ..... B63H 20/34 440/66
5,191,848 A * 3/1993 Hatfield ..... B63B 1/40 114/61.3
5,259,331 A * 11/1993 Hagan ..... B63H 5/16 114/61.1
5,911,187 A * 6/1999 Sohm ..... B63B 1/12 114/283
6,477,969 B2 * 11/2002 Schell-Tomczak .... B63H 20/06 440/49
6,482,056 B1 * 11/2002 Schell-Tomczak .... B63H 20/06 248/641
8,834,216 B1 9/2014 Calamia et al.
(Continued)

FOREIGN PATENT DOCUMENTS

WO WO-2007023928 A2 * 3/2007 ..... B63H 20/34

*Primary Examiner* — Magdalena Topolski
(74) *Attorney, Agent, or Firm* — BCF LLP

(57) ABSTRACT

A watercraft includes a deck, a hull supporting the deck, a mounting bracket, and a propulsion unit. The hull includes at least two pontoons. The mounting bracket is connected to a rear surface of a part of the hull. The propulsion unit is mounted to the part of the hull by the mounting bracket. A front surface of the propulsion unit is longitudinally spaced from the rear surface of the part of the hull. The part of the hull includes a deflector extending longitudinally rearward from the rear surface along at least part of lateral sides of the mounting bracket. Also, a hull for a watercraft includes a rear surface configured to connect to a mounting bracket of a propulsion unit, and a deflector extending longitudinally rearward from the rear surface, and shaped and sized to extend along at least part of lateral sides of the mounting bracket.

19 Claims, 9 Drawing Sheets

(56) References Cited

U.S. PATENT DOCUMENTS

| | | | | |
|---|---|---|---|---|
| 8,893,639 | B1 * | 11/2014 | Crate | B63H 20/34<br>114/274 |
| 11,613,329 | B2 * | 3/2023 | Lacefield | B63B 35/38<br>114/275 |
| 11,655,784 | B1 | 5/2023 | Broughton et al. | |

* cited by examiner

HULL WITH DEFLECTOR AND WATERCRAFT HAVING SAME

CROSS-REFERENCE

The present application claims priority to U.S. Patent Application No. 63/513,687, filed Jul. 14, 2023, which is incorporated by reference herein in its entirety.

TECHNOLOGICAL FIELD

The present technology relates to hulls having deflectors, and watercraft having hulls with deflectors.

BACKGROUND

Some watercraft have partially submerged outboard engines that are connected to a rear portion of their hull in such a manner that the outboard engine is longitudinally spaced from the rear portion.

During operation of the watercraft, water can flow in the longitudinal space between the outboard engine and the hull which can negatively impact the driving experience, such as, for example, by causing drag and providing an undesirable downward pressure at the rear of the watercraft.

In view of the foregoing, there is a desire for a hull and a watercraft that can mitigate at least some of the above-mentioned issues.

SUMMARY

It is an object of the present technology to ameliorate at least some of the inconveniences present in the prior art.

According to one aspect of the present technology, there is provided a watercraft including a deck, a hull, a mounting bracket, and a propulsion unit. The deck defines a longitudinal center plane. The hull supports the deck, and includes at least two pontoons connected to the deck. The mounting bracket is connected to a rear surface of a part of the hull. The propulsion unit is mounted to the part of the hull by the mounting bracket. A front surface of the propulsion unit is longitudinally spaced from the rear surface of the part of the hull. The part of the hull includes a deflector extending longitudinally rearward from the rear surface along at least part of lateral sides of the mounting bracket.

In some embodiments, the deflector is integral with the part of the hull.

In some embodiments, the deflector extends longitudinally rearward beyond the mounting bracket.

In some embodiments, the deflector extends vertically beyond a top of the mounting bracket.

In some embodiments, the watercraft further includes upper left and right panels, the left and right panels being connected to at least one of: the deflector and the part of the hull.

In some embodiments, the deflector includes upper left and right segments, at least part of each one of the upper left and right segments extending longitudinally rearward and laterally outward from the part of the hull, and each one of the upper left and right segments includes an angled section configured to deflect water flowing over the angled section as the watercraft moves forward laterally outward and vertically downward.

In some embodiments, the deflector includes lower left and right segments, each one of the lower left and right segments generally following an arcuate profile of the part of the hull.

In some embodiments, a lowermost point of the propulsion unit is disposed vertically below a lowermost point of the part of the hull, and the deflector defines a lower gap, such that the deflector has a left deflector portion and a right deflector portion, the lower gap being configured to receive at least part of the propulsion unit therein.

In some embodiments, the part of the hull is a pod disposed laterally between the at least two pontoons.

In some embodiments, the propulsion unit is a first propulsion unit, the mounting bracket is a first mounting bracket, the deflector is a first deflector, and the part of the hull is one of the at least two pontoons. The watercraft further includes a second mounting bracket and a second propulsion unit. The second mounting bracket is connected to a rear surface of an other one of the at least two pontoons. The second propulsion unit is mounted to the other one of the at least two pontoons by the second mounting bracket, a front surface of the second propulsion unit being longitudinally spaced from the rear surface of the other one of the at least two pontoons. The other one of the at least two pontoons includes a second deflector extending longitudinally rearward from the rear surface of the other one of the at least two pontoons along at least part of lateral sides of the second mounting bracket.

In some embodiments, the at least two pontoons is three pontoons, the three pontoons being laterally spaced. The part of the hull is a central pontoon of the three pontoons.

In some embodiments, an internal combustion engine of the propulsion unit is disposed at least partially below a waterline of the watercraft when the watercraft is at rest.

According to another aspect of the present technology, there is provided a hull for a watercraft. The hull includes a rear surface configured to connect to a mounting bracket of a propulsion unit, and a deflector extending longitudinally rearward from the rear surface, the deflector being shaped and sized to extend along at least part of lateral sides of the mounting bracket.

In some embodiments, the deflector is integral with the rear surface.

In some embodiments, the deflector is shaped to extend vertically upward beyond a top of the mounting bracket of the propulsion unit.

In some embodiments, the deflector includes upper left and right segments, at least part of each one of the upper left and right segments extending longitudinally rearward and laterally outward from the rear surface, and each one of the upper left and right segments including an angled section configured to deflect water flowing over the angled section as the watercraft moves forward laterally outward and vertically downward.

In some embodiments, the deflector defines a lower gap, such that the deflector has a left deflector portion and a right deflector portion, the lower gap being sized to receive at least part of a propulsion unit therein.

In some embodiments, the hull further includes a pod disposed centrally along a width the hull, the pod having the rear surface.

In some embodiments, the rear surface is a first rear surface, the mounting bracket of the propulsion units a first mounting bracket of a first propulsion unit, and the deflector is a first deflector.

The hull further includes a first pontoon having the first rear surface and the first deflector, and a second pontoon including a second rear surface configured to connect to a second mounting bracket of a second propulsion unit, and a second deflector extending longitudinally rearward from the second rear surface, the second deflector being shaped and sized to extend along at least part of lateral sides of the second mounting bracket.

In some embodiments, the at least two pontoons is three pontoons, the three pontoons being laterally spaced, and the part of the hull is a central pontoon of the three pontoons.

According to another aspect of the present technology, there is provided . . . according to the above aspect or according to the above aspect and one or more of the above embodiments.

For purposes of the present application, terms related to spatial orientation when referring to a watercraft and components in relation to the watercraft, such as "vertical", "horizontal", "forwardly", "rearwardly", "left", "right", "above" and "below", are as they would be understood by a driver of the watercraft sitting thereon in an upright driving position, with the watercraft being at rest and level.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
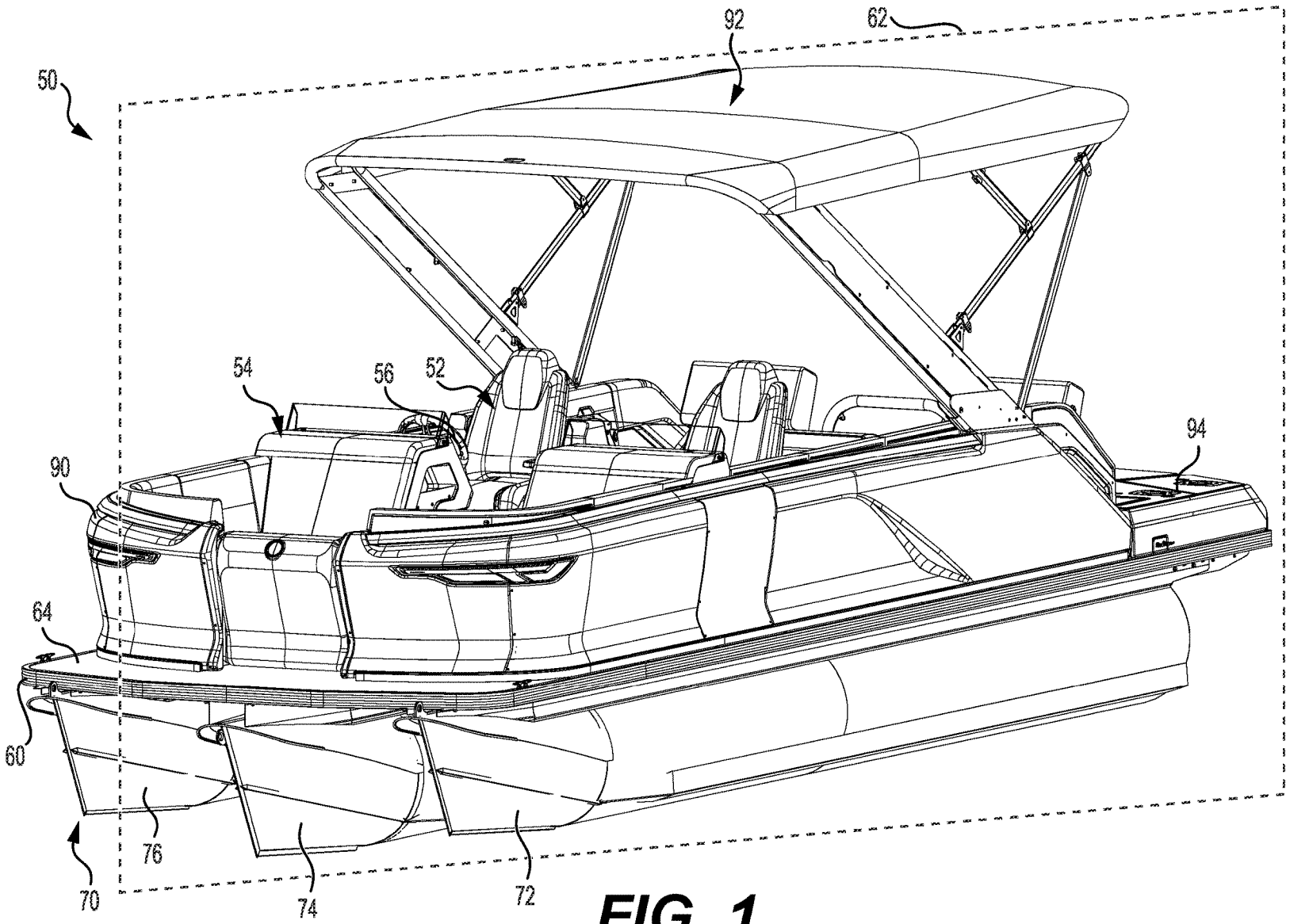
FIG. 1 is a perspective view taken from a top, front, left side of a watercraft according to an embodiment of the present technology.
Figure 2:
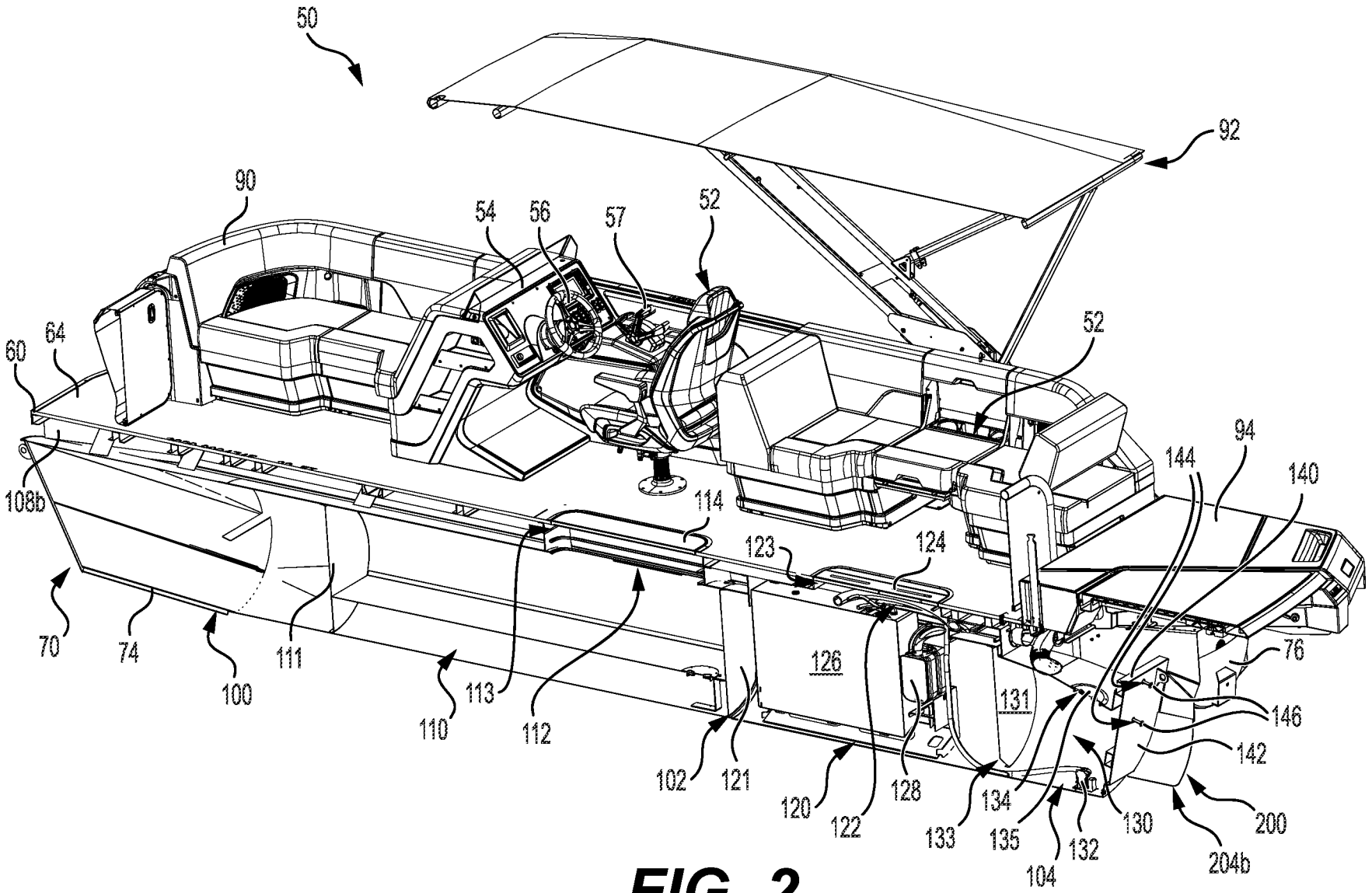
FIG. 2 is a perspective view taken from a top, rear, left side of a cross-section of the watercraft of FIG. 1, the cross-section being taken along a longitudinal vertical center plane of the watercraft, with an outboard engine of the watercraft of FIG. 1 being omitted.

A watercraft 50 in accordance with one embodiment of the present technology is shown in FIGS. 1 and 2. The following description relates to one example of a watercraft 50, notably a pontoon boat 50. Those of ordinary skill in the art will recognize that there are other known types of watercraft incorporating different designs and that the present technology would encompass these other watercraft.

The boat 50 has a deck 60 and a hull 70. The deck 60 is disposed on the hull 70, and is supported thereby. The deck 60 has an upper surface 64 for supporting occupants, as well as accessories and accommodations of the boat 50 including seats 52 and a command console 54. It is contemplated that the deck 60 could include multiple levels and/or other seating or other accessories integrated therein. The deck 60 defines a longitudinal center plane 62 that defines a left side and a right side of the boat 50.

The hull 70 includes three pontoons connected to the deck 60: a left pontoon 72, a center pontoon 74 and a right pontoon 76. As will be described below, it is contemplated that in other embodiments, the hull 70 may have a different number of pontoons. The left pontoon 72 is disposed on the left side of the boat 50, the right pontoon 76 is disposed on the right side of the boat 50, and the center pontoon 74 is disposed centrally along a width of the boat 50 such that a center plane 75 (shown in FIG. 5) of the center pontoon 74 is co-planar with the longitudinal center plane 62 (shown in FIG. 1) of the boat 60.

The boat 50 has a side structure 90 surrounding at least part of the deck 60 and extending upwardly therefrom. In the present embodiment, the side structure 90 is a barrier structure 90. It is contemplated that that in some embodiments, the side structure 90 could be gunnels of the boat 50 or another type of structure. The barrier structure 90 is located near a periphery of the boat 50 (as defined by the deck 60). The barrier structure 90 generally covers the front, left and right sides of the deck 60. It is contemplated that, in other embodiments, the barrier structure 90 could surround the deck 60 completely. The boat 50 further includes a bimini 92 connected to the barrier structure 90.

At a rear end thereof, the boat 50 has a platform 94. The platform 94 provides, beyond the barrier structure 90, additional space at the rear of the boat 50 which can facilitate access to the water.

Figure 6:
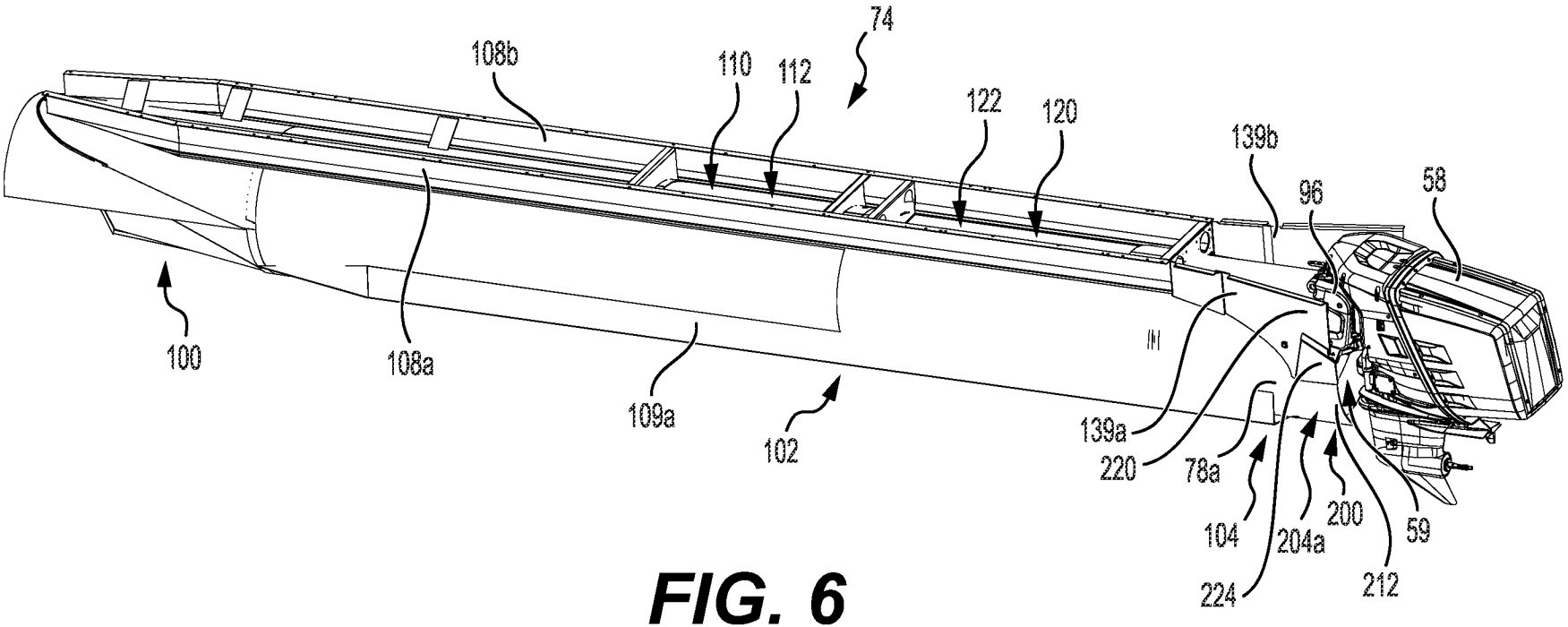
FIG. 6 is a perspective view taken from a top, rear, left side of the center pontoon of FIG. 4 with an outboard engine connected thereto.
Figure 7:
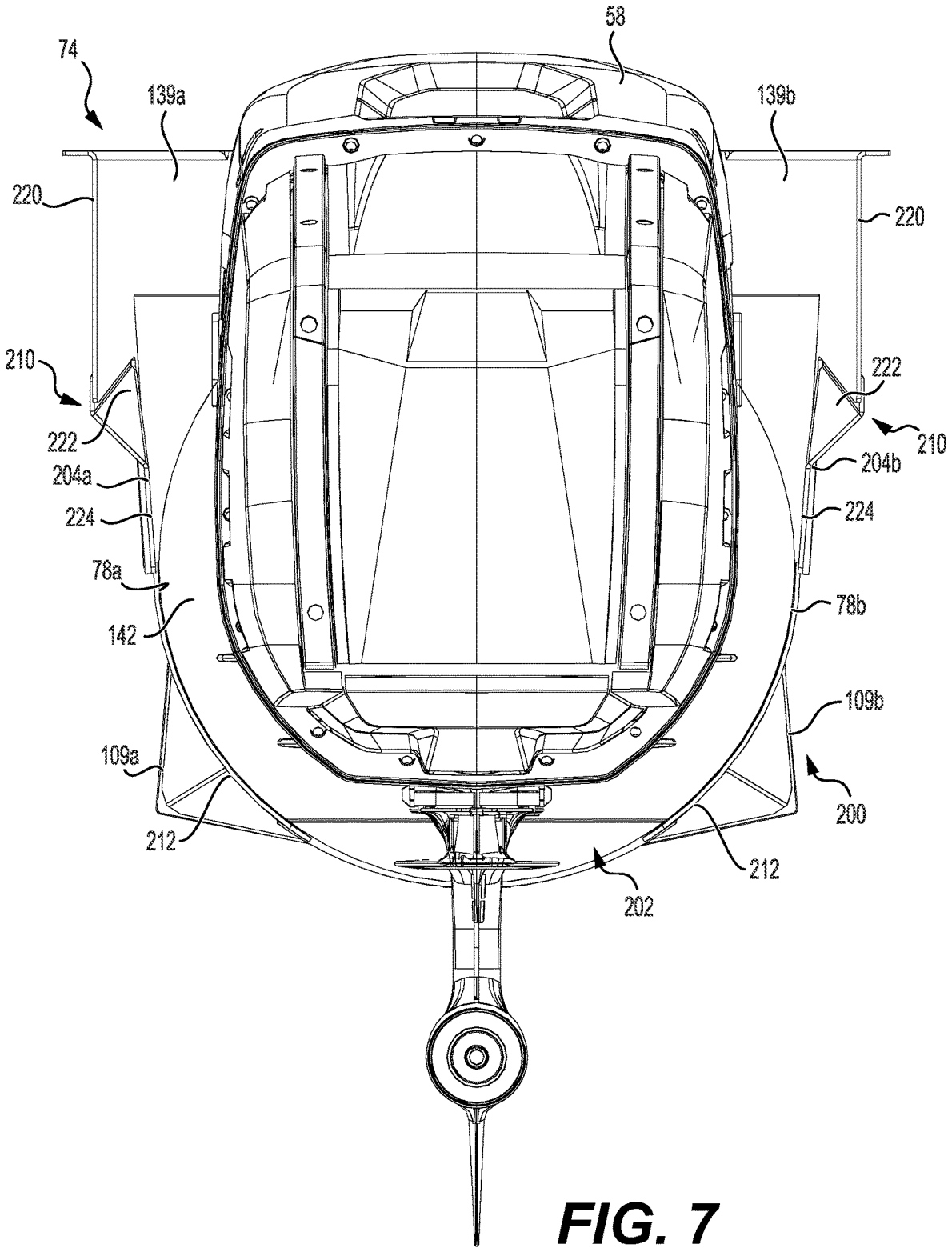
FIG. 7 is a rear elevation view of the center pontoon and the outboard engine of FIG. 6.

As best seen in FIG. 6, a propulsion unit 58 is connected to a mounting bracket 96, such that the propulsion unit 58 is mounted to the center pontoon 74 via the mounting bracket 96. The propulsion unit 58 is an outboard engine 58, which includes an internal combustion engine. Although it is called an outboard engine 58, it is contemplated that the outboard engine 58 could include an electric motor instead of an internal combustion engine. The outboard engine 58 is disposed at least partially below a waterline of the boat 50 when the boat 50 is at rest. An outboard engine similar to the outboard engine 58 is described in greater detail in U.S. Pat. No. 11,655,784, issued May 23, 2023, entitled "Marine Engine Assembly Having an Air Pump" the entirety of which is incorporated by reference herein.

The outboard engine 58 is operatively connected to a steering wheel 56 that is disposed on a command console 54, such that the boat 50 can be steered by causing the outboard engine 58 to pivot about a steering axis. It is contemplated that in other embodiments, the boat 50 could be steered by causing movement of one or more rudders. The outboard engine 58 is further operatively connected to a throttle 57 that is also disposed on the command console 54. The throttle 57 is configured to control the operation of the outboard engine 58 so as to control a speed of the boat 50.

The left and right pontoons 72, 76 are substantially the same. The center pontoon 74, while having some similarities with the left and right pontoons 72, 76, differs therefrom as it is configured to have the outboard engine 58 connected thereto. Notably, as will be described in greater detail below, the center pontoon 74 has a deflector 200.

With reference to FIGS. 3 to 7, the center pontoon 74 will now be described in more detail. The center pontoon 74 has left and right sides disposed on either sides of the center plane 75.

The center pontoon 74 is sized so as to extend, in the longitudinal direction, along an entirety of the length of the boat 50. The center pontoon 74 has a front portion 100, an intermediate portion 102 and a rear portion 104. Additionally, the center pontoon 74 has, extending upwardly from the front and intermediate portions 100, 102, a left connecting structure 108*a* and a right connecting structure 108*b*. The center pontoon 74 is connected to the deck 60 by the left and right connecting structures 108*a*, 108*b*. The center pontoon 74 also a left strake 109*a* and a right strake 109*b* (best seen in FIGS. 5 and 7). The left and right strakes 109*a*, 109*b* extends outwardly from the intermediate and rear portions 102, 104.

The front portion 100 has a hydrodynamic shape that can assist in reducing drag induced by the center pontoon 74 during movement of the boat 50, particularly in the forward direction. The front portion 100 is hollow. It is contemplated that the front portion 100 could contain closed-cell foam.

The intermediate portion 102, which has a generally hollow cylindrical shape, has a storage compartment 110 and a fuel tank compartment 120.

The storage compartment 110 is longitudinally delimited by a front wall 111 and a wall 121 (FIG. 2). An aperture 112 is defined in the intermediate portion 102 at a top of the storage compartment 110 for providing access thereto. The aperture 112 is aligned with a storage hatch 113 that is defined in the deck 60. The storage hatch 113 is closed by a storage hatch door 114 (partially shown in FIG. 2). Thus, the storage compartment 110 can be accessed by a user on the boat 50 by opening the storage hatch door 114.

The fuel tank compartment 120 is longitudinally delimited by the wall 121 and a wall 131 (FIG. 2). The fuel tank compartment 120 stores a fuel tank 126 and an oil tank 128, both of which are fluidly connected to the outboard engine 58. An aperture 122 is defined in the intermediate portion 102 at a top of the fuel tank compartment 120 for providing access thereto. The aperture 122 is aligned with a storage hatch 123 that is defined in the deck 60. The storage hatch 123 is closed by a storage hatch door 124 (partially shown in FIG. 2). Thus, the fuel tank compartment 120 can be accessed by the user on the boat 50 by opening the storage hatch door 124.

The rear portion 104, which is also hollow, has a rear chamber 130 that is longitudinally delimited by the wall 131 and a rear wall 140. The rear chamber 130 communicates with the fuel tank compartment 120 by an aperture 133 defined in the wall 131. In some instances, the rear chamber 130 could additionally communicated with the storage compartment 110. A bilge pump 132 is disposed in the rear chamber 130, and is configured to pump fluid out of the rear chamber 130 and out of the central pontoon 74.

The rear portion 104 defines, at a top of the rear chamber 130, an aperture 134 closed by a cap 135. The user can access the rear chamber 130 (e.g., to access the bilge pump 132) via the aperture 134 by removing the cap 135.

Above the rear chamber 130, the rear portion 104 has left and right upper walls 139*a*, 139*b*. The left and right upper walls 139*a*, 139*b* extend from rear ends of the connecting structures 108*a*, 108*b*, respectively, to the rear wall 140. Parts of the left and right upper walls 139*a*, 139*b* also extend laterally outward.

Figure 3:
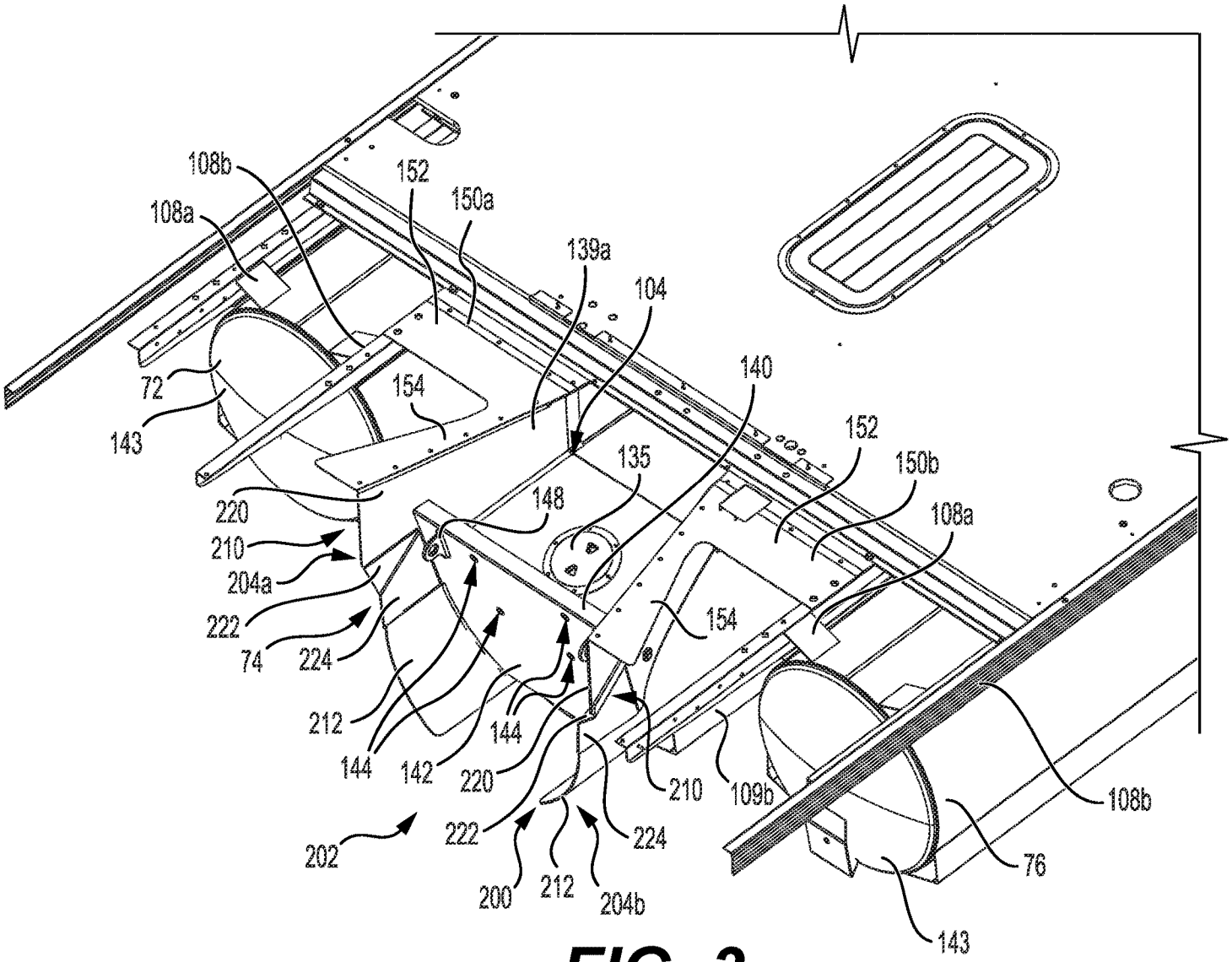
FIG. 3 is a perspective view taken from a top, rear, right side of a rear portion of the watercraft of FIG. 1, with a platform and part of a deck of the watercraft being omitted.
Figure 4:
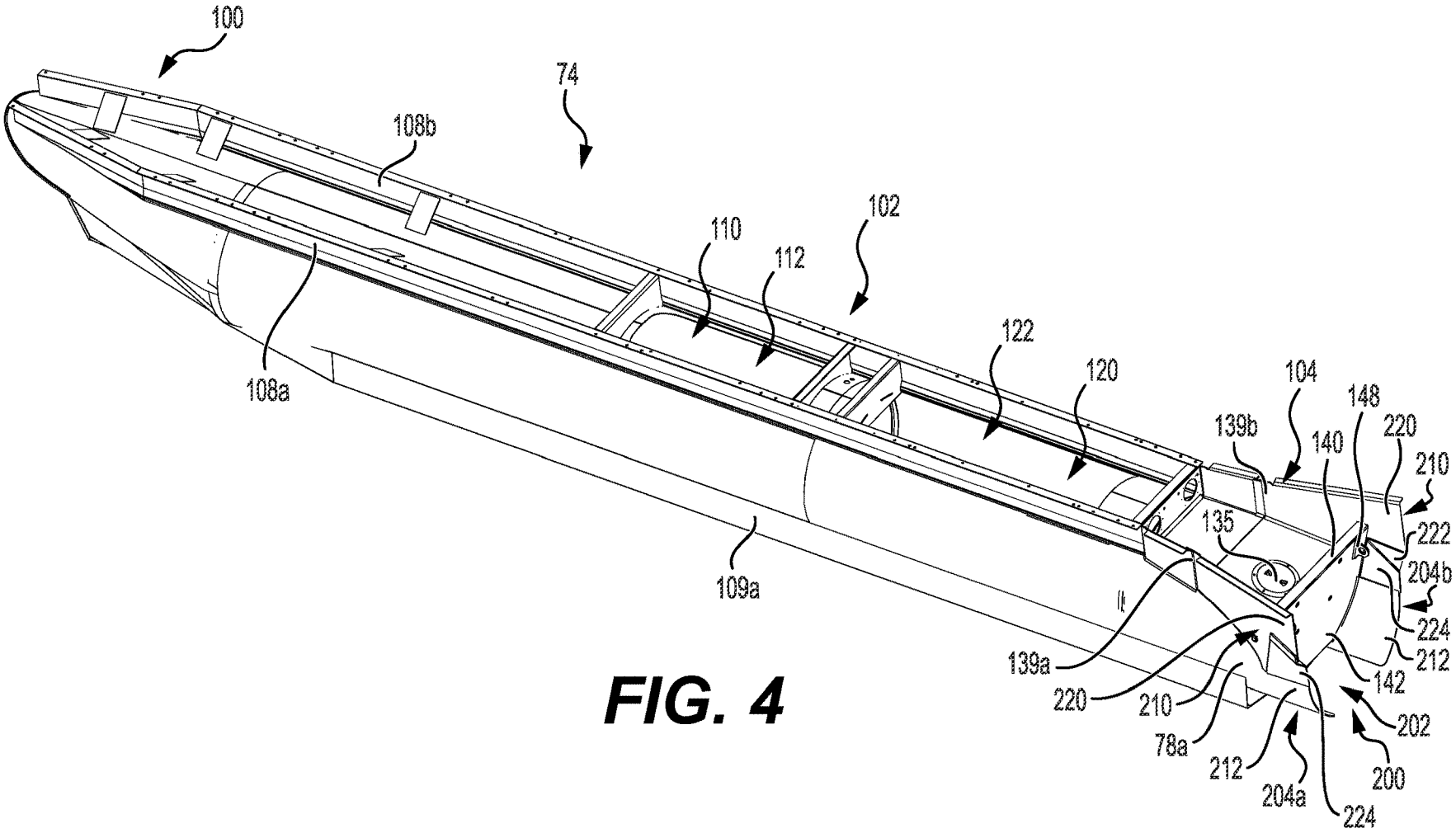
FIG. 4 is a perspective view taken from a top, rear, left side of a center pontoon of the watercraft of FIG. 1.

The rear portion 104 also has a rear surface 142. More specifically, the rear wall 140 has the rear surface 142. As best seen in FIG. 3, the rear surface 142 of the center pontoon 74 is disposed longitudinally rearwardly from rear surfaces 143 of the left and right pontoons 72, 76. The rear surface 142 being disposed further longitudinally rearward provides a more clearance for connecting the outboard engine 58 to the central pontoon 74.

The rear surface 142, which is generally flat, defines four apertures 144. It is contemplated that in some embodiments, the rear surface 142 could define more or less than four apertures 144. Each one of the four apertures 144 is configured to receive a fastener 146 therein (only two fasteners 146 shown in FIG. 2). The rear surface 142 also has two laterally spaced brackets 148. In some embodiments, the rear surface 142 could have more or less than two brackets 148.

In the illustrated embodiment, the mounting bracket 96 is connected to the rear surface 142 of the center pontoon 74 by the fasteners 146. It is contemplated that in other embodiments, the mounting bracket 96 could be connected to the rear surface 142 differently, and that the fasteners 146 could be omitted.

With reference to FIG. 3, the center pontoon 74 includes a left panel 150*a* and a right panel 150*b*. The left panel 150*a* is connected to the left side of the central pontoon 74, and to a right side of the left pontoon 72. The right panel 150*b* is connected to the right side of the central pontoon 74, and to a left side of the right pontoon 76. In other embodiments, the left and/or right panels 150*a*, 150*b* could be connected to another part of the hull 70.

The left and right panels 150*a*, 150*b* are mirror images of one another. Thus, only the left panel 150*a* will be described in detail herein.

The left panel 150*a* has a front section 152 that extends laterally and a rear section 154 that extends generally longitudinally. The front and rear sections 152, 154 generally form an L-shape. The front section 152 is sized to have its laterally outward end connect to a connecting structure 108*b* of the left pontoon 72, and to have its laterally inner end connect to the left upper wall 139*a* of the center pontoon 74. The rear section 154 is configured to connect to the upper left wall 139*a*, and as such, the orientation of the rear section 154 is generally aligned with the orientation of the upper left wall 139*a*. Thus, the rear section 154 extends longitudinally rearward and partially laterally outwardly from the front section 152. Furthermore, the rear section 154 is tapered in the longitudinal direction, such that a width of the rear section 154 increases as the rear section 154 extends longitudinally rearward.

The left and right panels 150*a*, 150*b* can assist in reinforcing the upper left and right walls 139*a*, 139, which can, during movement of the boat 50, be subjected to high stresses due to forces of water applied against the upper left and right walls 139*a*, 139.

With continued reference to FIGS. 3 to 7, the center pontoon 74 also includes the deflector 200, which will now be described in greater detail. The deflector 200 extends longitudinally rearward from the rear surface 142 along left and right lateral sides 78*a*, 78*b* of the center pontoon 74. In the illustrated embodiment, the deflector 200 is integral with the central pontoon 74. It is contemplated that in other embodiments, the deflector 200 could be a separate component connected to the center pontoon 74.

The deflector 200 is sized such that the deflector 200 extends longitudinally beyond the mounting bracket 96. In the illustrated embodiment, the deflector 200 also extends longitudinally beyond the front surface of the outboard engine 58. It is contemplated that in other embodiments, the deflector 200 could be longitudinally shorter. For example, the deflector 200 could be configured to extend so as to only extend beyond part of the mounting bracket 96. The deflector 200, which also extends in the vertical direction, is sized to extend beyond a top of the rear wall 140 and beyond a top of the mounting bracket 96. It is contemplated that the deflector 200 could be vertically shorter. For example, the deflector 200 could be configured to only extend until the top of the rear wall 140.

The deflector 200 defines a lower gap 202, such that the deflector 200 includes a left deflector portion 204*a* and a right deflector portion 204*b*. As will be described below, the lower gap 202 is configured to receive part of the outboard engine 58 therethrough. In some embodiments, the lower gap 202 could be omitted.

The left deflector portion 204*a* extends along the left lateral side 78*a* of the rear surface 142, whereas the right deflector portion 204*b* extends along the right lateral side 78*b* of the rear surface 142. The left and right deflector portions 204*a*, 204*b* are generally symmetrical about the center plane 75 of the center pontoon 74. As such, only the left deflector portion 204*a* will be described in detail herein. Corresponding features on the right deflector portion 204*b* have been labeled with the same reference numerals in the accompanying Figures.

The left deflector portion 204*a* has an upper left segment 210 and a lower left segment 212.

The upper left segment 210, at least part of which extends longitudinally rearward and laterally outward from the rear surface 142, includes an upper planar section 220, an angled section 222 disposed vertically below the upper planar section 220, and a lower planar section 224 disposed vertically below the angled section 222.

The upper planar section 220 is an extension of the left upper wall 139*a*, and as such, the upper planar section 220 and the left upper wall 139*a* are generally oriented in the same direction. Thus, the upper planar section 220 extends longitudinally rearward and laterally outward. The upper planar section 220 extends vertically such that a top thereof is disposed vertically higher than the top of the rear wall 140 and higher than the top of the mounting bracket 96. A bottom of the upper planar section 220 is disposed below the top of the rear wall 140. It is contemplated that the vertical span of the upper planar section 220 could vary from one embodiment to another. For example, in some instances, the top and/or the bottom of the upper planar section 220 could be generally aligned with the top of the rear wall 140.

The angled section 222 extends downwardly and laterally inwardly from the bottom of the upper planar section 220. More specifically, the angled section 222 is oriented such that a bottom thereof is disposed laterally inwardly from a top thereof. The angled section 222 has a triangular shape. It is contemplated that in other embodiments, the angled section 222 could have another shape. The configuration of the angled section 222 is such that when the boat 50 is moving in a forward direction, water flowing over the angled section 222 is deflected laterally outward and vertically downward.

The lower planar section 224 extends downwardly from the angled section 222. Due to the orientation and shape of the angled section 222, the lower planar section 224 has a trapezoidal shape. It is contemplated that in other embodiments, the lower planar section 224 could have another shape. The lower planar section 224 is configured to generally follow a profile of the left lateral side 78*a*. The profile of the left lateral side 78*a* along the lower planar section 224 is generally linear. Thus, the lower planar section 224 is also linear. The lower planar section 224 extends from the rear surface 142 generally orthogonally. It is contemplated that in some embodiments, the lower planar section 224 could extend from the rear surface 142 at an angle.

Figure 5:
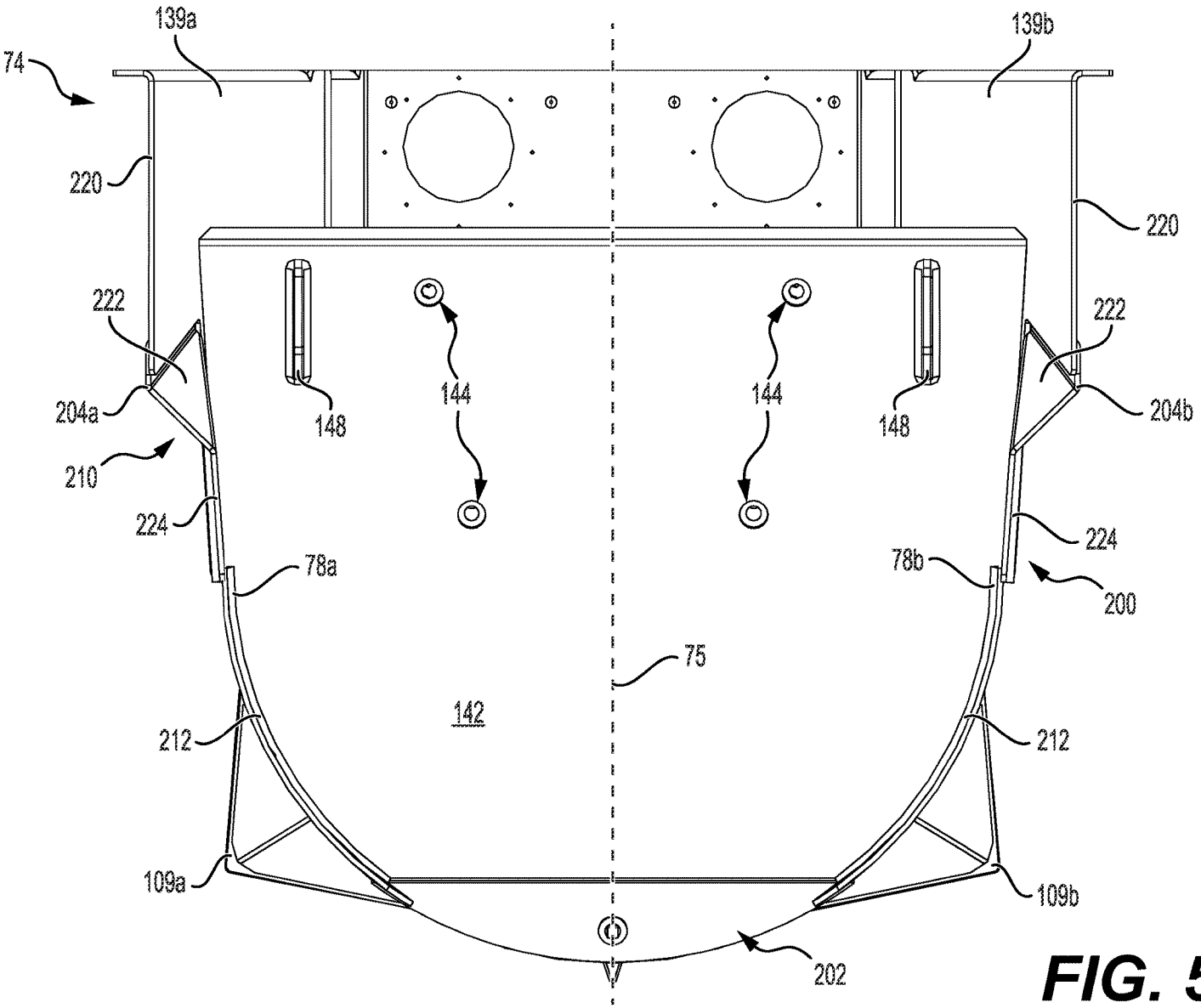
FIG. 5 is a rear elevation view of the center pontoon of FIG. 4.

The lower left segment 212, which extends below the lower planar section 224, is configured to further follow the profile of the left lateral side 78*a* of the rear wall 140. As can be seen in FIG. 5, a lower part of the left lateral side 78*a* has an arcuate profile. As such, the lower left segment 212 is arcuate. It is contemplated that in other embodiments where the lower part of left lateral side 78*a* could have another profile, the lower left segment 212 could not be arcuate.

When the outboard engine 58 is connected to the center pontoon 74, since a lowermost point of the outboard engine 58 is disposed vertically below a lowermost point of the center pontoon 74, part of the outboard engine 58 extends through the lower gap 202. Additionally, as best seen in FIG. 6, the rear surface 142 of the center pontoon 74 is longitudinally spaced from a front surface of the outboard engine 58, thereby defining longitudinal space 59 (FIG. 6) therebetween.

When the boat 50 is moving in forward direction and/or accelerating, water flow into the longitudinal space 59 is limited by the presence of the deflector 200. Since the deflector 200 extends longitudinally between the rear surface 142 and the front of the outboard engine 58, water that would otherwise flow into the longitudinal space 59 is deflected away from the longitudinal space 59 by the deflector 200.

Figure 8:
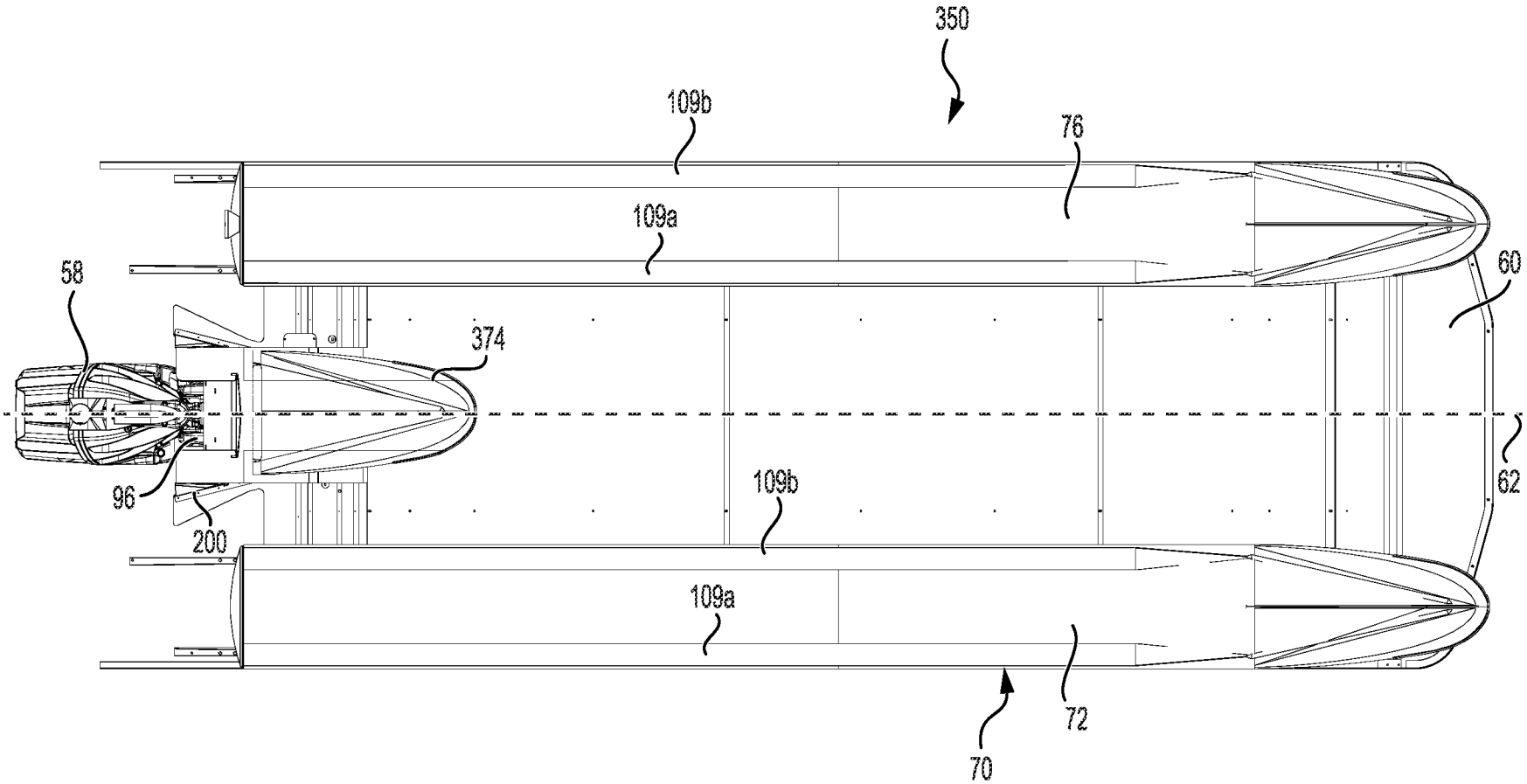
FIG. 8 is a bottom plan view of a watercraft according to an alternative embodiment of the present technology.

With reference to FIG. 8, an alternative embodiment of the boat 50, namely boat 350, will now be described. Features of the boat 350 similar to those of the boat 50 have been labeled with the same reference numerals, and will not re-described herein.

In the boat 350, the central pontoon 74 has been replaced by a center pod 374. The center pod 374 is centered along the width of the boat 350, and only extends longitudinally along a relatively short portion of the length of the boat 350. The center pod 374, which is hydrodynamically shaped, has the outboard engine 58 mounted thereto via the mounting bracket 96. The center pod 374 has the deflector 200.

Figure 9:
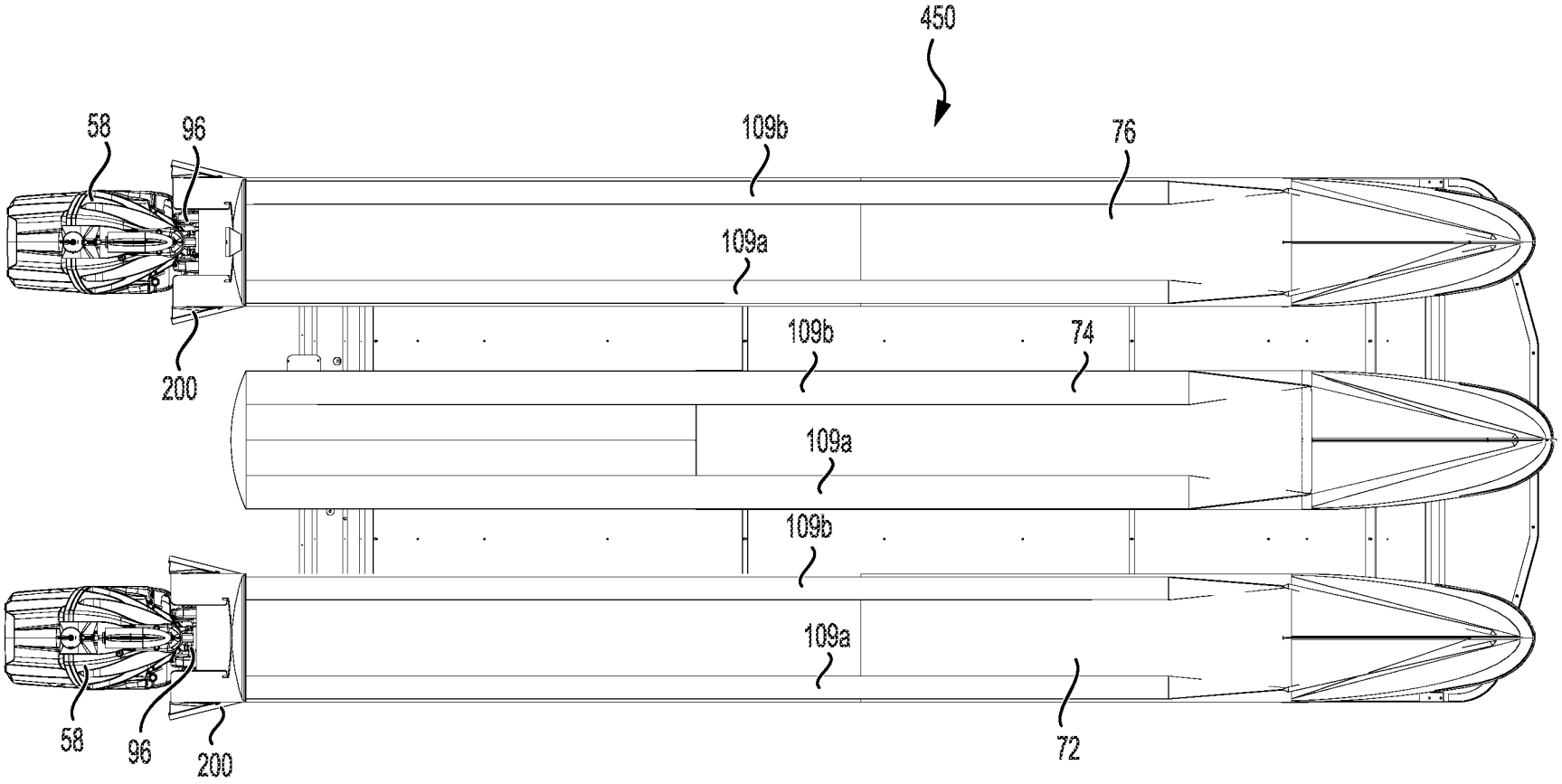
FIG. 9 is a bottom plan view of a watercraft according to another alternative embodiment of the present technology.

With reference to FIG. 9, another alternative embodiment of the boat 50, namely boat 450, will now be described. Features of the boat 450 similar to those of the boat 50 have been labeled with the same reference numerals, and will not re-described herein.

The boat 450 has two outboard engines 58 and two mounting brackets 96. Additionally, the outboard engines 58 are connected to the left and right pontoons 72, 76 instead of the center pontoon 74. Furthermore, the left and right pontoons 72, 75 each have a deflector 200, whereas the center pontoon 74 does not have a deflector 200.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A watercraft comprising:

a deck defining a longitudinal center plane;

a hull supporting the deck, the hull including at least two pontoons connected to the deck;

a first mounting bracket mounted to a rear surface of one of the at least two pontoons;

a first propulsion unit mounted to the one of the at least two pontoons by the first mounting bracket, a front surface of the first propulsion unit being longitudinally spaced from the rear surface of the one of the at least two pontoons; and the one of the at least two pontoons comprising a first deflector extending longitudinally rearward from the rear surface along at least part of lateral sides of the first mounting bracket;

a second mounting bracket mounted to a rear surface of an other one of the at least two pontoons;

a second propulsion unit mounted to the other one of the at least two pontoons by the second mounting bracket, a front surface of the second propulsion unit being longitudinally spaced from the rear surface of the other one of the at least two pontoons; and the other one of the at least two pontoons comprising a second deflector extending longitudinally rearward from the rear surface of the other one of the at least two pontoons along at least part of lateral sides of the second mounting bracket.

2. The watercraft of claim 1, wherein at least one of: the first deflector is integral with the one of the at least two pontoons, and the second deflector is integral with the other one of the at least two pontoons.

3. The watercraft of claim 1, wherein at least one of: the first deflector extends longitudinally rearward beyond the first mounting bracket, and the second deflector extends longitudinally rearward beyond the second mounting bracket.

4. The watercraft of claim 1, wherein at least one of: the first deflector extends vertically beyond a top of the first mounting bracket, and the second deflector extends vertically beyond a top of the second mounting bracket.

5. The watercraft of claim 4, further including upper left and right panels, the left and right panels being connected to;

at least one of:

the first deflector, and the one of the at least two pontoons, or at least one of:

the second deflector, and the other one of the at least two pontoons.

6. The watercraft of claim 1, wherein;

the first deflector includes first upper left and right segments, at least part of each one of the first upper left and right segments extending longitudinally rearward and laterally outward from the one of the at least two pontoons, and each one of the first upper left and right segments includes an angled section configured to deflect water flowing over the angled section as the watercraft moves forward laterally outward and vertically downward; and the second deflector includes second upper left and right segments, at least part of each one of the second upper left and right segments extending longitudinally rearward and laterally outward from the other one of the at least two pontoons, and each one of the second upper left and right segments includes an angled section configured to deflect water flowing over the angled section as the watercraft moves forward laterally outward and vertically downward.

7. The watercraft of claim 1, wherein; the first deflector includes first lower left and right segments, each one of the first lower left and right segments generally following an arcuate profile of the one of the at least two pontoons; and the second deflector includes second lower left and right segments, each one of the second lower left and right segments generally following an arcuate profile of the other one of the at least two pontoons.

8. The watercraft of claim 1, wherein:

a lowermost point of the first propulsion unit is disposed vertically below a lowermost point of the one of the at least two pontoons;

the first deflector defines a first lower gap, such that the first deflector has a first left deflector portion and a first right deflector portion, the first lower gap being configured to receive at least part of the first propulsion unit therein;

a lowermost point of the second propulsion unit is disposed vertically below a lowermost point of the other one of the at least two pontoons; and the second deflector defines a second lower gap, such that the second deflector has a second left deflector portion and a second right deflector portion, the second lower gap being configured to receive at least part of the second propulsion unit therein.

9. The watercraft of claim 1, wherein at least one of an internal combustion engine of the first propulsion unit or an internal combustion engine of the second propulsion unit is disposed at least partially below a waterline of the watercraft when the watercraft is at rest.

10. A watercraft comprising:

a deck defining a longitudinal center plane;

a hull supporting the deck, the hull including three pontoons connected to the deck, the three pontoons being laterally spaced;

a mounting bracket mounted to a rear surface of a central pontoon of the three pontoons;

a propulsion unit mounted to the central pontoon by the mounting bracket, a front surface of the propulsion unit being longitudinally spaced from the rear surface of the central pontoon; and the central pontoon comprising a deflector extending longitudinally rearward from the rear surface along at least part of lateral sides of the mounting bracket.

11. The watercraft of claim 10, wherein the deflector is configured to deflect water laterally outward from the rear surface.

12. The watercraft of claim 10, wherein the deflector is integral with the rear surface.

13. The watercraft of claim 10, wherein the deflector is shaped to extend vertically upward beyond a top of the mounting bracket of the propulsion unit.

14. The watercraft of claim 10, wherein the deflector includes upper left and right segments, at least part of each one of the upper left and right segments extending longitudinally rearward and laterally outward from the rear surface, and each one of the upper left and right segments including an angled section configured to deflect water flowing over the angled section as the watercraft moves forward laterally outward and vertically downward.

15. The watercraft of claim 10, wherein the deflector defines a lower gap, such that the deflector has a left deflector portion and a right deflector portion, the lower gap being sized to receive at least part of a propulsion unit therein.

16. The watercraft of claim 10, wherein the deflector extends longitudinally rearward beyond the mounting bracket.

17. The watercraft of claim 10, further including upper left and right panels, the left and right panels being connected to at least one of: the deflector and the central pontoon.

18. The watercraft of claim 10, wherein the deflector includes lower left and right segments, each one of the lower left and right segments generally following an arcuate profile of the central pontoon.

19. The watercraft of claim 10, wherein an internal combustion engine of the propulsion unit is disposed at least partially below a waterline of the watercraft when the watercraft is at rest.

* * * * *